US007934525B2

(12) United States Patent
Bolton

(10) Patent No.: US 7,934,525 B2
(45) Date of Patent: May 3, 2011

(54) HANDS FREE WOOD SPLITTER

(75) Inventor: Stoney Dale Bolton, Jacksboro, TN (US)

(73) Assignee: Stoney Dale Bolton, Jacksboro, TN (US)

( * ) Notice: Subject to any disclaimer, the term of this patent is extended or adjusted under 35 U.S.C. 154(b) by 50 days.

(21) Appl. No.: 12/474,369

(22) Filed: May 29, 2009

(65) Prior Publication Data

US 2009/0236011 A1 Sep. 24, 2009

Related U.S. Application Data

(63) Continuation-in-part of application No. 11/973,171, filed on Oct. 6, 2007, now abandoned.

(51) Int. Cl.
*B27L 7/02* (2006.01)

(52) U.S. Cl. .... 144/366; 144/4.6; 144/193.2; 144/195.8

(58) Field of Classification Search ..... 144/4.6, 144/193.1, 193.2, 194, 195.1, 195.7, 195.8, 144/335, 359, 366

See application file for complete search history.

(56) References Cited

U.S. PATENT DOCUMENTS

| | | | | |
|---|---|---|---|---|
| 4,091,851 | A * | 5/1978 | Ober | 144/193.1 |
| 4,160,472 | A | 7/1979 | Blackstone | |
| 4,211,265 | A * | 7/1980 | Thackery | 144/194 |
| 4,315,534 | A * | 2/1982 | Blackstone | 144/194 |
| 4,403,635 | A * | 9/1983 | York | 144/366 |
| 4,646,800 | A * | 3/1987 | Wentzell | 144/194 |

* cited by examiner

*Primary Examiner* — Shelley Self

(57) ABSTRACT

A hands-free wood (log segment) splitting apparatus and method of employing a mobile vehicle having mounted thereon the splitting apparatus. The splitting apparatus includes a mount removably secured to the mobile vehicle and having secured thereon a rotatable auger, the location of the mount and the components carried thereon being safely remote from an operator. Control over the positioning of the apparatus, including the auger relative to a to-be-split log segment, control over the movement of the auger relative to the log segment being split, restraining the log segment from undesired movement relative to the spinning auger, and other related actions, are effected by the operator from the remote location and without exposure of the operator to personal injury from the splitting apparatus. Guides are provided for entry thereof into a split to serve as impediments to collapse of the split portions of the log segment against the auger.

12 Claims, 5 Drawing Sheets

HANDS FREE WOOD SPLITTER

CROSS-REFERENCE TO RELATED APPLICATIONS

This is a Continuation-In-Part of U.S. patent application Ser. No. 11/973,171, filed Oct. 6, 2007, entitled HANDS FREE WOOD SPLITTER

STATEMENT REGARDING FEDERALLY-SPONSORED RESEARCH OR DEVELOPMENT

Not Applicable

BACKGROUND OF THE INVENTION

1. Field of Invention

This invention relates generally to an apparatus and method for splitting sizeable pieces of wood, such as log segments, into multiple smaller pieces. (herein the pieces of wood are referred to a "log segments", but it will be understood that other shapes of wood may be split employing the present invention.) More specifically, this invention relates to an apparatus and method for splitting log segments employing a mobile vehicle such as a farm tractor, Bobcat®, backhoe or the like, preferably having hydraulic power associated with the vehicle. In accordance with one aspect of the present invention a log segment is engaged by a hydraulically powered tapered auger whereupon the auger is rotated and digs into the log segment, causing the log segment to split along its grain. Depending upon the nature of the log segment (particularly the grain direction) and/or the toughness of the log segment, multiple insertions of the auger into the log segment may be required for completion of a given splitting event.

2. Description of the Related Art

Historically, axes, hammered wedges, mauls or like instruments have been the tool of choice for splitting log segments. Although the axe is ideal for cutting into wood, axes, wedges and mauls have limited applicability in splitting log segments because of their narrow head. Furthermore, using these instruments requires a large amount of strength and energy and may inflict serious injury to a user.

One alternative to traditional methods of splitting logs is a screw-auger log splitter. Such prior art screw-auger splitters are disclosed in U.S. Pat. No. 4,160,472 issued on Jul. 10, 1979 depicting an apparatus for splitting wood using a conical device attached to a vehicle wheel hub that rotates as the wheel is driven; and U.S. Pat. No. 4,315,534 issued on Feb. 16, 1982 depicting a conically-shaped wood splitter designed for use with a power takeoff and three-point hitch of a tractor. In general these prior art screw-auger splitters are extremely dangerous because they require the operator to physically grasp and move the log segment into engagement the spinning screw-auger. These screw-auger log splitters generally require a large amount of strength and energy from the operator in pulling and tugging the log segment into engagement with the spinning auger and retaining the log segment in position to be split. Another alternative apparatus for splitting log segments is a hydraulically powered log splitter comprising a hydraulic ram and wedge assembly wherein the wedge is pressed into the log segment by the hydraulic ram, usually into one end of the log segment. Typically, an operator of a hydraulic log splitter has to personally lift, carry and load large heavy log segments onto the hydraulic log splitter itself or into some other position whereby the wedge can be driven into the log segment and to maintain the log segment in such position while activating the hydraulic power source for the log splitter for such time as required to force the log into contact with the wedge that results in splitting the log segment. The shortcomings, problems and danger associated with such hydraulic log splitters are evident to one skilled in the art.

BRIEF SUMMARY OF THE INVENTION

In accordance with one aspect of the present invention the inventor provides a hands-free wood (log segment) splitting apparatus and method employing a motorized, omni-directional mobile vehicle having mounted thereon a hydraulically powered splitting apparatus. In a preferred embodiment, the apparatus is mounted on moveable arms associated with the vehicle. In one embodiment, the present apparatus includes a mount on which there is provided a rotating auger, and or other components of the apparatus. Preferably this mount is removably secured on the lift arms of the vehicle where such arms are available. Again preferably, the location of the mount and the components carried on the mount is located safely remote from an operator. In the present invention, control over the positioning of the auger relative to a log segment, control over the movement of the auger relative to the log segment being split, and restraining the log segment from undesired movement relative to the spinning auger during a splitting event, and/or other related actions, are effected by the operator from their remote location and without exposure of the operator to personal injury by unintended movement(s) of the log segment, for example, or other sources of potential injury to an operator. Hence, as used herein, the term "hands-free" refers to a log segment splitting event wherein positioning of the apparatus of the present invention relative to a log segment to be split, engagement and disengagement of a splitting auger, activation and deactivation of the auger itself, retention of the log segment in the course of it being split, and all similar or related activities are carried out by a human operator without the necessity of the operator laying hands on the log segment or the splitting apparatus (other than conventional controls located remote from the actual physical splitting actions) so that the splitting event may be set up, effected and controlled by the operator located remotely of the log segment and auger, for example). Furthermore, in one embodiment, the present invention may provide hands-free and relatively effortless transportation of log segments in preparation for splitting, during splitting and disposal of split portions of the log segment. In particular the preset apparatus provides protection from inadvertent jamming of the auger within a partially split log segment, protection against inadvertent engagement of the auger with a supporting surface for the log segment, for initial positioning of the log segment relative to the auger, for altering or retaining the engagement of the auger with the auger, and rotational direction of the auger during a splitting event.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
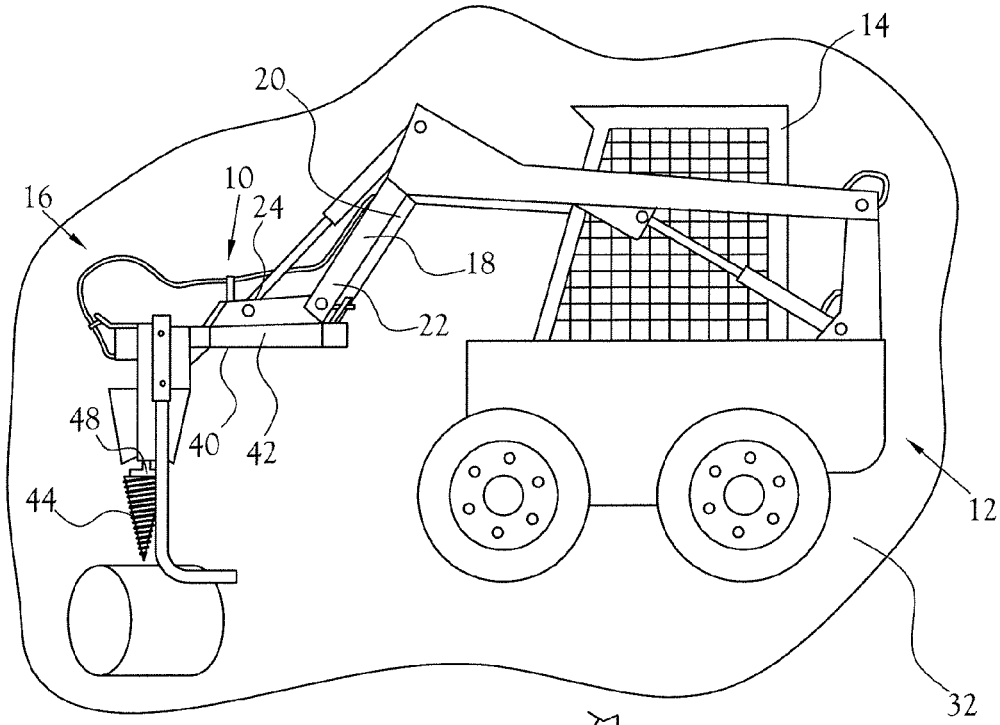
FIG. 1 is a perspective view of one embodiment of apparatus of the present invention as attached to a mobile vehicle.
Figure 2:
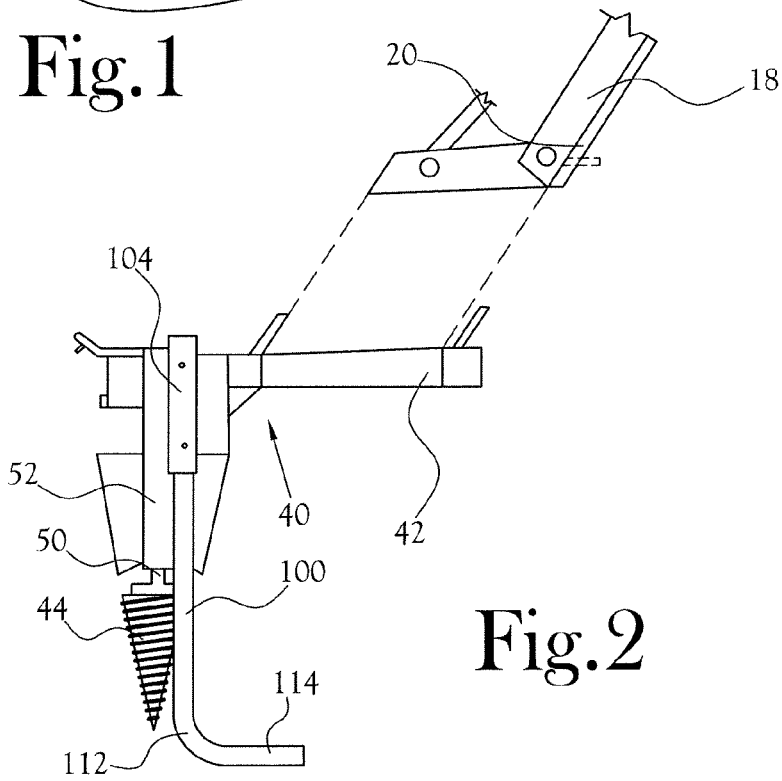
FIG. 2 is a perspective view of a portion of the apparatus depicted in FIG. 1 and including one mode of releasable attachment of one embodiment of a mount element of the apparatus of the present invention to the arms of a mobile vehicle.

Referring initially to FIG. 1, in the depicted embodiment, the present hands-free log segment splitter 10 comprises a mobile vehicle 12, preferably self-propelled and of multidirectional maneuverability. In the depicted embodiment, the vehicle is provided with a cage 14 containing various control elements and within which an operator may reside while operating the vehicle and the log segment splitting subassembly 16 of the present invention. This vehicle may be chosen from several known motorized vehicles, such as the skid steer loader depicted in FIG. 1, or other vehicles such as a farm tractor, a Bobcat®, backhoes, or trackhoes, for example. As depicted, preferably the vehicle includes one or more arms 18, 20 which are pivotally or similarly mounted on the vehicle as is well known in the art. Such arms may be moveable, extendable and retractable, only within a fixed plane. In any event, in accordance with one aspect of the present invention, at least one 18 of the arms is adapted to removably receive thereon a log segment splitting subassembly 16, preferably on the outboard end 22 of the arm, in a manner which permits positioning of the subassembly generally vertically above a supporting surface 32 such as the ground, for example, and in position for engagement of an auger 44 mounted on the subassembly relative to a log segment 30 to be split. If lateral movement of the arm(s) independently of the vehicle itself is not available, desirably the vehicle itself includes the ability to move forwardly and backwardly, and laterally over the supporting surface to thereby position the splitting subassembly relative to a log segment lying on the supporting surface, for example.

As seen in the several Figures, the splitting subassembly comprises a mount 40 which may be in the form of a frame or a rigid planar element 42. In either event, the mount is adapted to have affixed thereto an auger 44. In the depicted embodiment, such auger is mounted on one end 48 of a shaft 50 which, in turn, is rotationally mounted within an elongated housing 52 that is affixed to the mount. The outboard end 54 of the shaft is exposed for receipt thereon of a drive pulley or sprocket 56.

A power source for rotation of the shaft may be provided by any suitable conventional drive, preferably a hydraulic motor 60 (see FIG. 5) which is connected to the sprocket on the auger shaft, as by a link chain 61. Other equivalent drive sources and their coupling to the pulley or sprocket, or direct to the auger shaft, will be recognized by one skilled in the art. In the embodiment depicted in FIGS. 5 and 6, a hydraulic motor is affixed onto the mount 40 proximate the auger shaft 50 and interconnected to the shaft sprocket as by a link chain. Conduits 66, 68 for the flow of a hydraulic fluid to and from the motor for operative control of the motor are provided, leading from the location of the motor to a location remote from the mount. In the depicted embodiment, such conduits lead to the cage 14 of the loader vehicle 12 where they are accessible by an operator. Conventional controls for the speed of rotation, on and off and rotational direction of the auger may be provided as desired. Alternatively, the hydraulic power source may be associated with (connected into) a hydraulic system of the vehicle, or the hydraulic motor may be independent of the vehicle hydraulic system. In either event control over the auger is effected from a location (e.g. cage 14) sufficiently remote from the splitting subassembly mount 40 as preludes the operator from being exposed to spinning auger itself, the drive system for rotation of the auger, and/or the log segment being split or transferred to or from a storage or other location.

Figure 4:
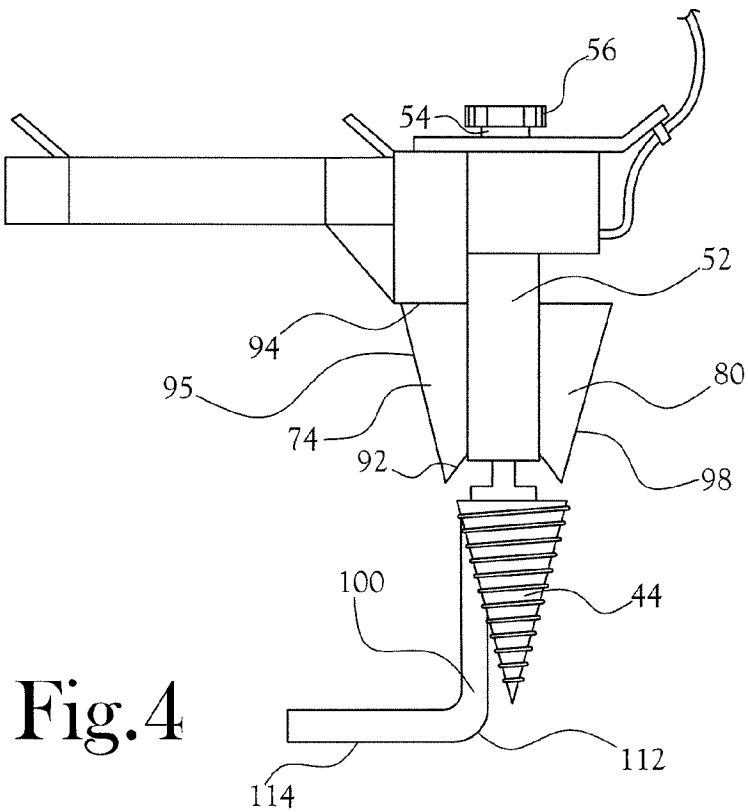
FIG. 4 is a right-side plan view of a portion of the embodiment of the mount element depicted in FIG. 1.
Figure 3:
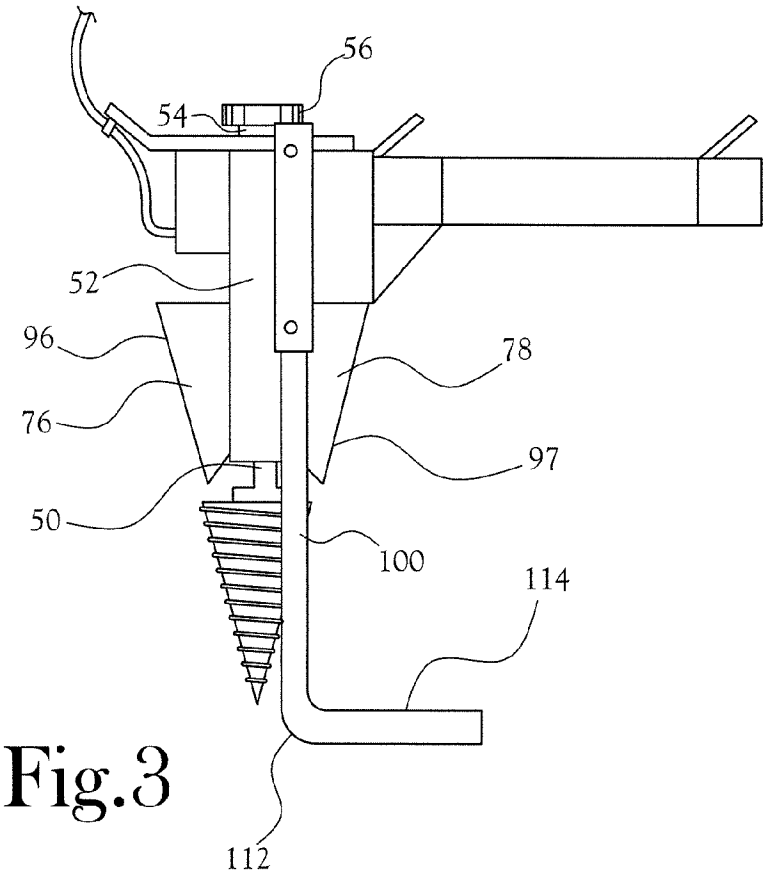
FIG. 3 is a left-side plan view of a portion of the embodiment of the mount element of the apparatus depicted in FIG. 1.
Figure 5:
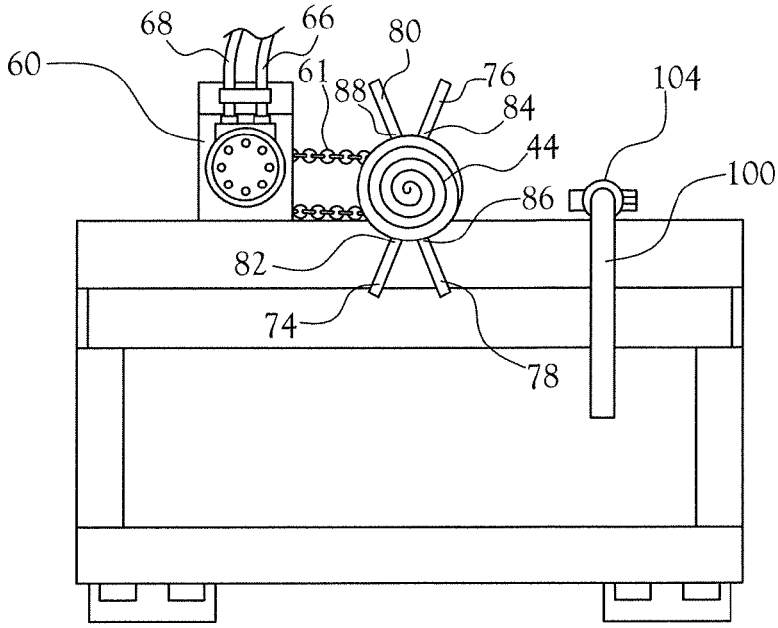
FIG. 5 is a top view of the embodiment of the mount element of the apparatus depicted in FIG. 3 including a drive element for the auger of the embodiment of the mount element depicted in FIG. 3.
Figure 6:
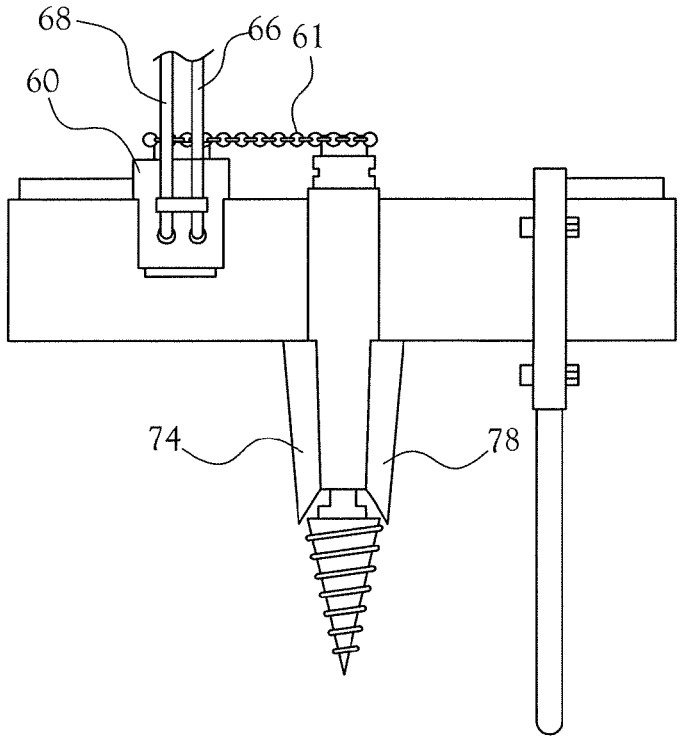
FIG. 6 is a front plan view of the embodiment of the mount element of the apparatus depicted in FIG. 5.
Figure 7:
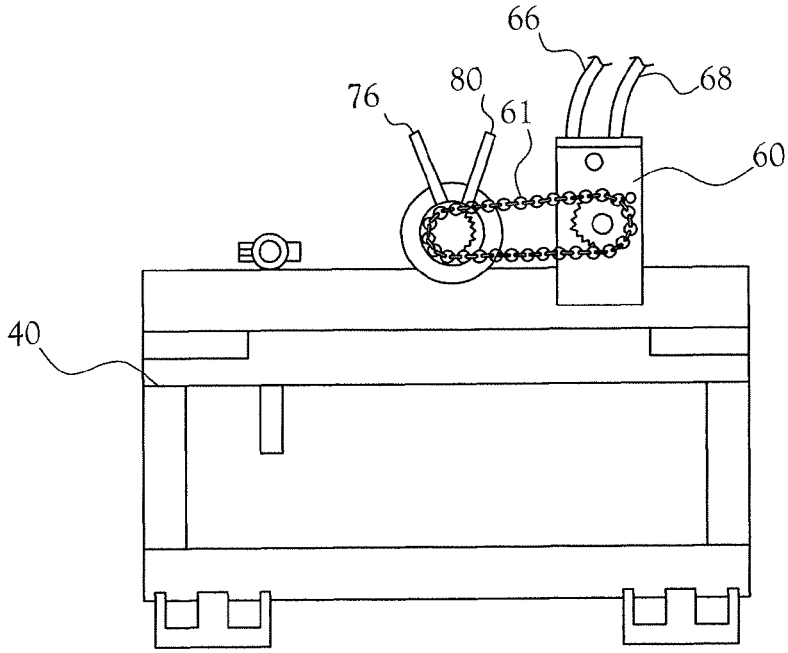
FIG. 7 is a top view of the embodiment of the mount element of the apparatus depicted in FIG. 5.
Figure 8:
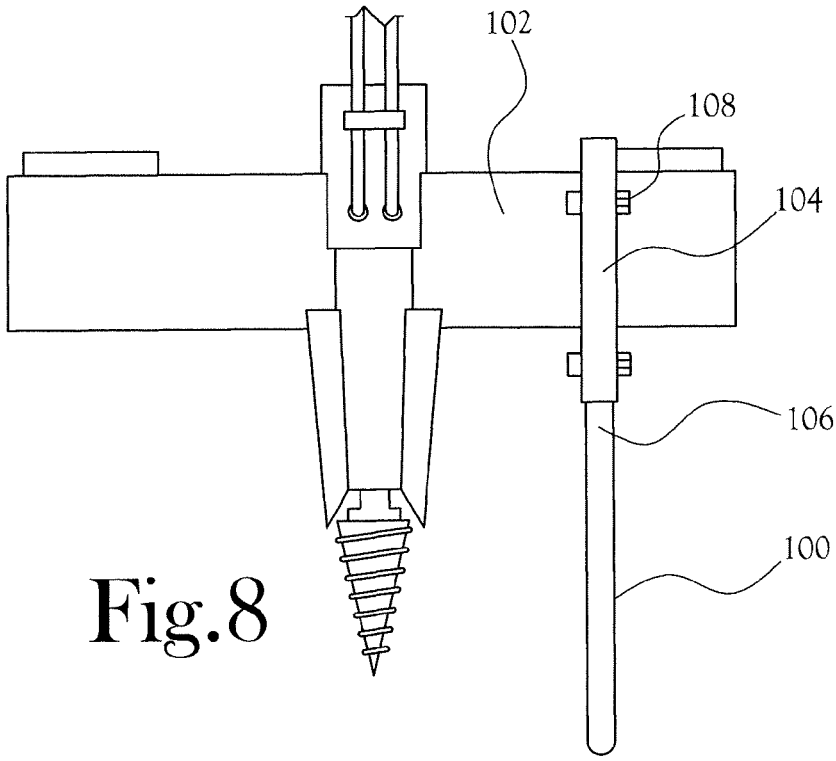
FIG. 8 is an alternate embodiment of the mount element depicted in FIG. 4 and depicted a motor connected directly to the auger of the mount element of the apparatus depicted in FIG. 4.

In the course of a splitting event, not uncommonly, the spinning auger may partially penetrate the log segment and become bound between split portions of the log segment. As seen in several Figures, FIGS. 4-6 in particular, as an aid toward prevention of this auger-binding occurrence, the present inventor provides at least one 78 and preferably four, planar rigid guides 74-80 (see FIGS. 3, 5, and 6) fixedly secured to the housing 52 for the auger shaft 50. In the depicted embodiment, one edge 82 of each guide 74, for example, is anchored, e.g. welded, to the housing along the length of the housing. When two guides 76, 78 as depicted in FIG. 3, are employed, these guides preferably are positioned in spaced apart relationship to one another on opposite sides of the housing, ie., spaced apart by 180 degrees around the outer circumference of the housing. When employing four such rigid guides, as depicted in FIG. 5, the guides are spaced apart around the outer circumference of the shaft housing 52. As depicted, the outer exposed edges of 95, 96, 97 and 98 the guides 74, 76, 78 and 80, respectively, are tapered from a relatively narrow end 92 of guide 74 (typical) proximate the auger to a relatively wider opposite end 94 of guide 74 (typical). By this means, the guides may enter a partially split log segment, following the entry of the auger, to retain the split portions of the log segment spaced apart from one another either as the splitting progresses and/or as a bridging factor upon temporary or permanent withdrawal of the auger from the split in question. The guides, as depicted in FIG. 5, are configured to retain and divert the split portions of the log segment along the tapered edge of the guide to prevent the split portions of the log segment from contact with the mount and thereby obstructing the splitting progress. Such action avoids the need for the operator to leave their remote control position to free the auger, and where such operator would be grossly exposed to potential injury while freeing the auger.

As seen in FIGS. 4-8, the auger of the splitting subassembly mount is protected from damaging engagement with the ground or other supporting surface for the log segment being split. To this end, the inventor provides at least one elongated restrictor 100 secured to one side 102 of the mount 40 of the splitting subassembly 16. Such mounting may take the form of a tubular housing 104 secured (as by welding, for example) to the side of the mount of the splitting subassembly and adapted to receive therein a first end 106 of the elongated restrictor 100. In one embodiment, such end 106 of the restrictor is slidably received within the housing and anchored in any selected position as by bolts 108 or like fasteners. As seen in the Figures, the outboard end 110 of the restrictor comprises a 90 degree angular bend 112 in the restrictor so that such outboard end defines a footing 114 which discourages the outboard end of the restrictor from "digging" into the ground as opposed to maintaining the mount in spaced apart relationship to the ground. As seen in FIG. 1, the outboard end of the restrictor extends from the mount and beyond the auger so that the restrictor engages the supporting surface and holds the auger off the supporting surface. Additional restrictors may be provided on the mount in spaced apart relationship to the first restrictor for enhancing the functioning of such restrictors. Moreover, as desired, each such restrictor may be adjusted to extend the outboard end of such restrictor sufficiently beyond the auger as to permit the restrictor to define a guide for the placement of a log segment in position under the auger for splitting and/or to retain the log segment in its preferred position during the course of a splitting event.

Figure 9A:
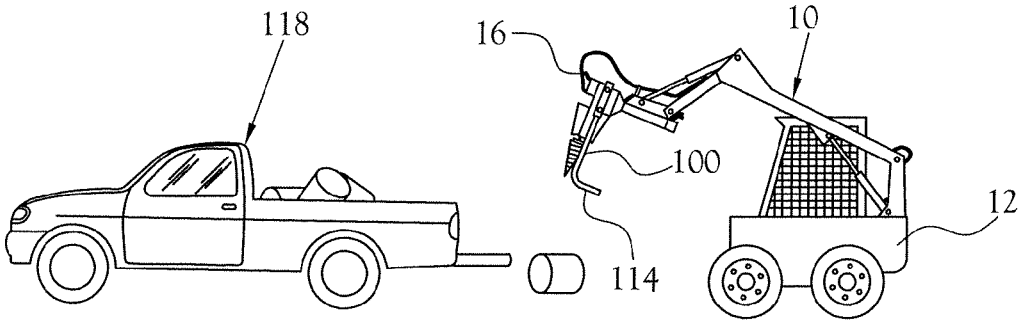
FIG. 9*a* is a representation of a mobile vehicle having arms adapted to grasp a log segment preparatory loading or unloading of such log segment onto a truck.
Figure 9B:
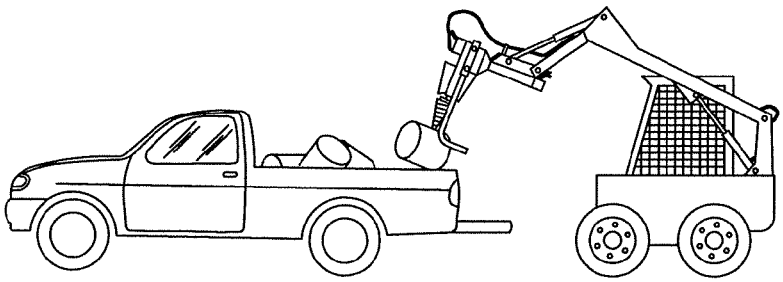
FIG. 9*b* is a representation of the mobile vehicle of FIG. 9*a* and depicting the loading or unloading of a log segment onto a truck; and, FIG. 9*c* is a representation of the mobile vehicle of FIG. 9*a* and depicting the completion of a loading or unloading of a log segment onto a truck.
Figure 9C:
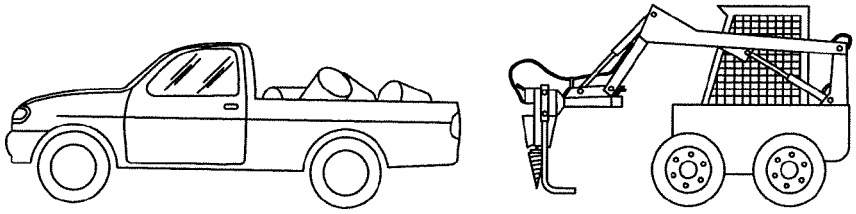

As depicted in FIGS. 9*a*-9*c*, when employing a vehicle having properly movable arms, the apparatus of the present invention may include unloading of log segments from a truck 118 and subsequent loading of split log segments into a truck for transfer to a storage location, for example. In one embodiment for loading a log segment on a truck (or otherwise relocating a log segment) from their remote control location an operator may engage the log segment with the auger and rotate the auger only sufficient to drive the auger a short distance (e.g. 2 inches) into the log segment thereby providing for lifting of the log segment for relocation by movement of the arms of the vehicle or by relocating the vehicle itself.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A hands-free wood splitting assembly removably and operatively attachable to a mobile vehicle, the mobile vehicle including an arm having a first end pivotally mounted on the mobile vehicle and a distal end extending from the mobile vehicle to carry said wood splitting assembly remotely of the mobile vehicle, the arm being moveable relative to the mobile vehicle, the mobile vehicle having an operator position to support a human operator thereon remotely of said wood splitting assembly, said wood splitting assembly comprising:

an auger;

a housing operatively connected to the distal end of the arm to rotatably receive said auger;

a source of rotational power located at the distal end of the arm to rotate said auger;

a control element located at the operator position and remote from said auger to enable the human operator to control movement of the arm and rotation of said auger to engage said auger with a log segment to split the log segment and/or to pick-up and relocate the log segment; and at least two rigid guide members affixed to said housing to enter a split developed in the log segment by said auger such that portions of a partially split log segment are precluded from collapsing against said auger in the split.

2. The apparatus of claim 1 including first and second rigid guide members affixed to said housing, each guide member extending along the length of said housing in spaced apart locations about an outer circumference of said housing, and projecting laterally outwardly from said housing to enter a split created in the log segment by said auger and provide an impediment to rebound of split portions of the log segment against said auger.

3. The apparatus of claim 2 and including third and fourth rigid guide members affixed to said housing, each guide member extending along the length of said housing in spaced apart locations about the outer circumference of said housing, and projecting laterally outwardly from said housing to enter a split created in the log segment by said auger and provide further impediment to rebound of split portions of the log segment against said auger.

4. The apparatus of claim 1 wherein said source of rotational power comprising a hydraulic-based power source.

5. The apparatus of claim 4 wherein said source of rotational power comprises a hydraulic motor connected to hydraulic lines of the mobile vehicle.

6. The apparatus of claim 1 and including at least a first restrictor carried at the distal end of the arm and projecting therefrom substantially parallel to said auger, said first restrictor comprising a rigid rod having a distal end extending past said auger to prevent said auger from engaging the ground, said distal end of said first restrictor including a lateral extension to prevent rotation of the log segment when said auger is engaged with the log segment.

7. A method for hands-free splitting of a log segment comprising the steps of:

a. providing a moveable arm having a first end pivotally mounted on a mobile vehicle and a distal end extending from the mobile vehicle to carry a wood splitting assembly remotely of the mobile vehicle;

b. securing said wood splitting assembly to the distal end of the moveable arm, said wood splitting assembly including a source of rotational power located at the distal end of the moveable arm to rotate an auger rotatably received within a housing, said housing having at least two rigid guide members affixed to said housing to enter a split developed in a log segment by said auger such that portions of a partially split log segment are precluded from collapsing against said auger in said split, said mobile vehicle having an operator position to support a human operator thereon, said mobile vehicle providing a control element located at said operator position and remote from said auger to enable the human operator to control movement of the moveable arm and rotation of said auger; and c. operating said control element from the operator position on the mobile vehicle for:

i. manipulating said moveable arm of the mobile vehicle to position said auger proximate to the log segment, ii. engaging said auger with the log segment, iii. rotating said auger, iv. generating a split in the log segment, v. advancing at least two rigid guide members into said split to retain and divert the log segment from collapsing against said auger, and vi. advancing said auger into said split to separate the log segment into multiple pieces.

8. The method of claim 7 and including the operation of providing a restrictor to prevent engagement of said auger with the ground.

9. The method of claim 7 and including the operation of picking-up and relocating the log segment preceding the operation of advancing said auger into said split to separate the log segment into multiple pieces.

10. A hands-free wood splitting assembly comprising:

a multidirectional mobile vehicle having an operator position to support a human operator thereon;

an arm having a first end pivotally mounted on said mobile vehicle and a distal end extending from the mobile vehicle, said distal end of said arm being remote from said operator position, said arm being moveable relative to the mobile vehicle;

an auger;

a housing operatively connected to the distal end of the arm to rotatably receive the auger;

a source of rotational power located at said distal end of the arm to rotate said auger;

a control element located at said operator position and remote from said auger to enable the human operator to control movement of the arm and rotation of the auger to engage the auger with said log segment to split the log segment and/or to pick-up and relocate the log segment;

at least two rigid guide members affixed to said housing to enter a split developed in said log segment by said auger such that portions of a partially split log segment are precluded from collapsing against said auger in said split; and a first restrictor secured to said mount and projecting therefrom substantially parallel to said auger shaft, said first restrictor comprising a rigid rod having a first end thereon affixed to said frame and a distal end extending past said auger to prevent said auger from engaging the ground, said distal end of said first restrictor including a lateral extension to prevent rotation of said log segment when said auger is engaged with said log segment.

11. The apparatus of claim 9 including first and second rigid guide members affixed to said housing, each guide member extending along the length of said housing in spaced apart locations about an outer circumference of said housing, and projecting laterally outwardly from said housing to enter a split created in said log segment by said auger and provide an impediment to rebound of split portions of said log segment against said auger.

12. The apparatus of claim 10 including third and fourth rigid guide members affixed to said housing, each guide member extending along the length of said housing in spaced apart locations about the outer circumference of said housing, and projecting laterally outwardly from said housing to enter a split created in said log segment by said auger and provide further impediment to rebound of split portions of said log segment against said auger.

* * * * *